United States Patent [19]

Zimmerman et al.

[11] 3,998,725

[45] Dec. 21, 1976

[54] METHOD OF REMOVING ALKYL LEAD COMPOUNDS FROM LIQUID HYDROCARBON FUELS

[75] Inventors: Abraham A. Zimmerman, New Providence; George S. Musser, Warren, both of N.J.

[73] Assignee: Exxon Research & Engineering Co., Linden, N.J.

[22] Filed: Apr. 30, 1975

[21] Appl. No.: 573,121

[52] U.S. Cl. ..... 208/253

[51] Int. Cl.[2] ..... C10G 17/00

[58] Field of Search ..... 208/251 R, 253, 299

[56] References Cited

UNITED STATES PATENTS

| | | | |
|---|---|---|---|
| 2,453,138 | 11/1948 | Kharasch | 208/253 |
| 2,504,134 | 4/1950 | Kharasch | 208/251 |
| 2,745,793 | 5/1956 | Jezl et al. | 208/251 |
| 3,793,185 | 2/1974 | Whitehurst et al. | 208/251 |
| 3,893,912 | 7/1975 | Zimmerman | 208/253 |
| 3,893,913 | 7/1975 | Zimmerman | 208/253 |
| 3,944,501 | 3/1976 | Whitehurst et al. | 208/251 R |

*Primary Examiner*—Delbert E. Gantz
*Assistant Examiner*—James W. Hellwege
*Attorney, Agent, or Firm*—Wayne Hoover

[57] ABSTRACT

A method for separating organometallic compounds from liquid hydrocarbons containing the same wherein the liquid hydrocarbon is contacted with a contact material comprising: an adsorbent selected from the group consisting of alumina, silica-alumina and silica gel; cupric chloride impregnated on the adsorbent; and water. The presence of water in the contact material is essential to good separation performance. The contact material may also comprise an amine which may be present either as a reaction product or a complex.

14 Claims, 2 Drawing Figures

METHOD OF REMOVING ALKYL LEAD COMPOUNDS FROM LIQUID HYDROCARBON FUELS

BACKGROUND OF THE INVENTION

This invention relates to a process for separating organometallic compounds from liquid hydrocarbons. More particularly, this invention relates to a process for separating organolead compounds from liquid hydrocarbons.

As is well known, there is an increasing public and governmental interest in eliminating or at least significantly reducing the amount of pollutants emitted to the atmosphere as the result of combustion of various fuels in internal combustion engines. As is also well known, the amount of pollutants emitted to the atmosphere can be significantly reduced by passing the exhaust through one or more catalytic converters. Generally, however, the catalysts used in these converters are not effective in treating exhausts obtained from the combustion of leaded fuels. As a result, it has become necessary to provide unleaded fuels for use in vehicles equipped with such converters.

The production of lead-free or substantially lead-free fuels is, of course, well within the ordinary skill of the art. Delivery of such fuels to the consumer, however, cannot be as easily acccomplished. In fact, past experience with both lead-free and low fuels has indicated that intentional and/or inadvertent comingling of such fuels with leaded fuels renders such ultimate delivery impossible, at least, in 100% of the cases. Such comingling could occur in the pipelines of transport tankers as well as in storage tanks at terminals or retail outlets. The need, then, for a method, short of separate transport and storage facilities, which would ensure the delivery of a substantially lead-free fuel is readily apparent.

One such method which could be used is a separation method which would permit separation of relatively minor amounts of lead from the fuel stored at a terminal or a retail outlet (after transport) or from the gasoline in a tanker or pipeline or delivery truck prior to tranfer into a storage vessel. Indeed, several separation processes have, heretofore, been proposed for the separation of organolead compounds from gasoline. Generally, these have been two-step processes wherein the organolead compound is first converted to an insoluble or more readily absorbed form and thereafter separated either by absorption, water washing, filtration and/or decanting. Often, the chemical conversion is accomplished with a Lewis acid such as stannic chloride, and in some cases the separation effected with an adsorbent such as activated charcoal. These prior art methods have, however, been primarily concerned with the separation of relatively high concentrations of lead (greater than 1 gram lead per gallon of gasoline) from relatively small volumes of gasoline and are not ideally suited to use for the separation of relatively small concentrations of lead (less than 0.5 grams lead per gallon of gasoline) from comparatively large volumes of gasoline. Moreover, these prior art processes often result in an undesirable increase in the gum content of the treated gasoline.

More recently, and as is known from copending application Ser. No. 405,124, filed Oct. 10, 1973, it has been discovered that certain activated charcoals, which have been impregnated with a hydrous ferric chloride, can be used to separate organolead compounds from gasoline and many of the aforementioned disadvantages of the prior art processes avoided thereby. The absorption or separation capacity of the ferric chloride impregnated carbons is significantly reduced, however, if the treated gasolines contain relatively large amounts of either light or heavy cat naphthas. As also recently discovered, and known from copending application Ser. No. 458,669, certain activated carbons can be impregnated with cupric chloride and effectively used to separate organolead compounds from gasolines, and these cupric chloride impregnated adsorbents are surprisingly effective when used with gasolines containing light and heavy naphthas. These particular impregnated adsorbents are, however, most effective in separating tetraethyl lead and, while effective with tetramethyl lead and equilibrated mixtures of tetramethyl and tetraethyl leads, they are not as effective with these particular lead compounds as would be desired, generally, in a large scale deleading operation. The need, then, for a separation process geared to the treatment of large volumes of gasoline without substantially increasing the gum content thereof and which can be effectively used with gasolines containing relatively large concentrations of light and/or heavy cat naphthas and for the separation of tetramethyl lead and/or equilibrated mixtures of tetramethyl and tetraethyl leads, is, therefore, believed to be readily apparent.

SUMMARY OF THE INVENTION

It has now been found that the foregoing and other deficiencies of the prior art organolead separation processes can be avoided with the process of this invention and a process well suited to the separation of relatively small concentrations of lead and particularly tetramethyl lead and equilibrated mixtures of tetramethyl lead and tetraethyl lead from relatively large volumes of liquid hydrocarbon provided thereby. It is, therefore, an object of this invention to provide an improved process for separating organolead compounds and particularly tetramethyl lead and equilibrated mixtures of tetramethyl lead and tetraethyl lead from liquid hydrocarbons. It is another object of this invention to provide such a process wherein the separation is accomplished at a relatively high rate. It is still another object of this invention to provide such a process which may be used without substantially increasing the gum content of the liquid hydrocarbons subjected to treeatment. It is yet another object of this invention to provide such a process which can be used effectively with gasolines containing light and/or heavy cat naphthas and with a relatively good capacity. Still other objects and advantages will become apparent from the disclosure set forth hereinafter.

In accordance with the present invention, the foregoing and other objects and advantages are accomplished with a process wherein a liquid hydrocarbon containing one or more organolead compounds is contacted with a contact material comprising an adsorbent selected from the group consisting of alumina, silica-alumina and silica gel, said adsorbent having a cupric chloride impregnated thereon. As is pointed out more fully hereinafter, it is essential that the contact material comprise water and that the adsorbent have a relatively large pore volume and exhibit a relatively high surface area. As is also pointed out more fully hereinafter, the contact material may also comprise an amine, which amine may be present either as a reaction product or complex.

DETAILED DESCRIPTION OF THE INVENTION

Figure 1:
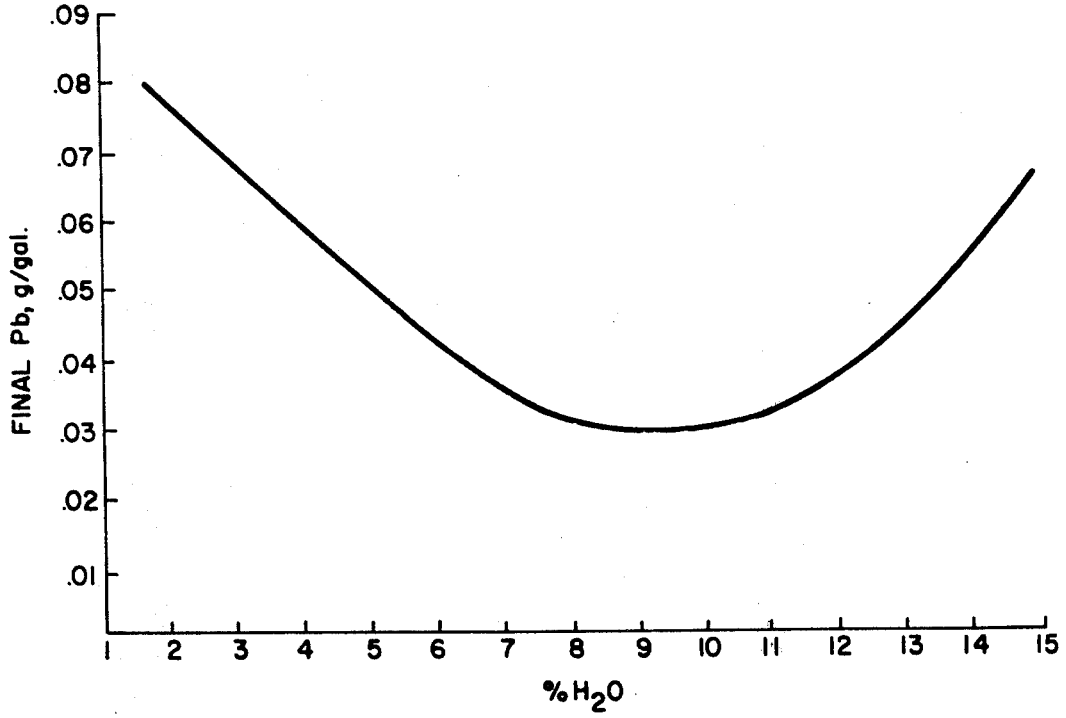
FIG. 1 is a plot illustrating the effect of water content on separation efficiency and based on the data obtained in Example 4.

Broadly, the method of this invention can be used to separate or remove organolead compounds from any hydrocarbon which might contain such organolead compounds in a dissolved form. The process may, then, be used to separate organolead compounds from normally gaseous hydrocarbons which have been made liquid as a result of increased pressure as well as solid or highly viscous hydrocarbons which had been made liquid as the result of increased temperature. The process is, however, most useful for the separation of organolead compounds from mixtures of normally liquid hydrocarbons, which mixtures may contain one or more gaseous hydrocarbons dissolved therein. Mixtures of this type include diesel fuel, heating oil, jet fuel and kerosene and the like and leaded and unleaded fuels such as gasoline. The method of this invention is, however, most useful for the separation of organolead compounds from unleaded gasolines which may, as the result of contamination, contain relatively minor amounts of organolead compounds. Surprisingly, it has been discovered that only a limited number of the aluminas, silica-aluminas and silica gels known in the prior art can be used effectively as adsorbents in the method of this invention. In this regard, it should be noted that it is considered essential that the adsorbent exhibit a relatively high total pore volume and surface area. More specifically, it is believed essential to effective operation of the process of this invention that the adsorbent exhibit a total pore volume within the range from about 0.7 to about 1.5 cc/g and a surface area within the range from about 100 to about 800 $m^2/g$.

As will be readily apparent, the particle size of the adsorbent used in the contact material of this invention is not critical. Indeed, the method would be quite operative with any particle size provided that the other critertion are satisfied and provided that satisfactory means for separating the contacted material and the hydrocarbon are used. In this regard, it should be noted that essentially any of the filtration or centrifugation methods known in the prior are could be used to separate particles too small to be separated with any other means in either a batch or continuous operation. Similarly, any other means known to be effective in separating solids from liquids could be employed to effect the desired separation. It is, however, most expedient and effective to carry out the method of the present invention in such a way as to either eliminate or at least minimize the need for such solid separation and to minimize contacting time. For this reason, it is preferred to accomplish the contacting by passing the liquid hydrocarbon through a fixed bed of the contact material. When this method is used, a granular type adsorbent could be used and the particle size would, generally, range between about 0.005and 0.20 inches.

In general, any of the cupric chlorides, including both hydrous and anhydrous cupric chloride, may be used to impregnate the adsorbent used in the contact material of the present invention. Since water will always be present in the final contact material, however, the use of hydrious cupric chloride is preferred. As is well known, the hydrous cupric chlorides may be represented by the formula $CuCl_2 \cdot xH_2O$ wherein $x$ is generally 2. These compounds may, of course, be readily prepared with methods well known in the prior art or the same may be obtained commercially from several sorces.

The contact materials used in the method of this invention will be prepared by first dissolving a cupric chloride in a suitable solvent such as water or a water-alcohol mixture and then combining the cupric chloride solution with a suitable adsorbent. The concentration of cupric chloride in the solution as well as the amount of such solution used in combination with the adsorbent is, of course, not critical to the invention and a satisfactory impregnated product can be obtained over a relatively broad range of such conditions. Best results, however, will be obtained when the total concentration of cupric chloride in solution is sufficient to provide the desired concentration of cupric chloride on the adsorbent and when the total amount of solution employed is sufficient to insure good wetting thereof, and hence, good distribution of the cupric chloride without providing a large excess of solvent which must later be removed. Generally, the cupric chloride solution and the adsorbent will be contacted in such a manner as to insure good distribution of the cupric chloride over the adsorbent. This can, of course, be readily accomplished with any of the well-known mixing techniques. After the cupric chloride solution and the adsorbent have been contacted for a sufficient period of time, excess solvent will be removed. Again, this can be accomplished with methods well known in the prior art such as by drying at an elevated temperature in an oven and/or by contacting the impregnated adsorbent with an inert stripping gas such as nitrogen or air. It will, of course, be appreciated that the drying time and/or conditions can be controlled such that the resulting impregnated adsorbent may contain any desired concentration of water within the pores thereof.

Generally, and when an amine or amine complex is not used, a satisfactory cupric chloride-impregnated adsorbent can be prepared by first forming a solution of hydrous cupric chloride containing between about 5 and 15 wt. % cupric chloride and thereafter containing contacting between about 1 and 2 milliliters of this solution per gram of adsorbent. This contacting can be accomplished at any temperture and pressure at which the cupric chloride remains in solution and at which the solution remains liquid. Generally, the contacting will be continued for a period of time sufficient to permit a complete wetting of the adsorbent. Following this contacting, the wetted adsorbent will be treated so as to remove at least 50 wt. % of the solvent and water, including any water derived from the hydrous cupric chloride as well as any that might be contained in the adsorbent, and most generally so as to remove between about 70 and 95 wt.% of such total solvent and water. Generally, the contact materials which may be used in the method of this embodiment of the invention will contain between about 5 and 20 wt. % $CuCl_2$, between about 65 and 92 wt. % adsorbent (on a water-free basis) and between about 3 and 15 wt. % water.

As indicated previously, any suitable solvent for the cupric chloride could be used to effect the desired impregnation of the adsorbent. Since the final contact material is to contain water, however, it has been found most convenient to use water or a mixture containing water as the solvent. In this latter regard and when a mixture is used it is most convenient to use a mixture wherein the other constituents thereof are more volatile than water. Mixtures containing water and the lower alcohols such as methanol, ethanol and isopropanol are, then, most effective and when used, such mixtures will, generally, comprise 10 to 50 wt. % water and 90 to 50 wt. % of the lower alcohol or alcohols.

In the broadest embodiment of this invention, organolead compounds will be separated from liquid hydrocarbons by first contacting a liquid hydrocarbon containing one or more organolead compounds with a cupric chloride impregnated adsorbent and thereafter separating either the liquid hydrocarbon from the impregnated adsorbent or separating the impregnated adsorbent from the liquid hydrocarbon. The desired contacting may be accomplished either in a batch, semibatch or continuous operation and as indicated, supra, essentially any impregnated adsorbent or contact material particle size could be used. Where the particle size is relatively small, however, it will be necessary to separate the contact material from the liquid hydrocarbon with a suitable method such as filtration or centrifugation. Where the particle size is somewhat larger, however, separation might be accomplished by settling followed by decanting or again with methods such as filtration and centrifugation. Where the particle size is sufficiently large and particularly in the range previously specified, it will be possible to effect the contacting in a fixed bed of the contact material in which case the liquid hydrocarbon will, effectively, be separated from the contact material after the desired contacting has been accomplished.

Broadly, the method of this invention may be used to treat liquid hydrocarbons containing essentially any possible concentration of dissolved organolead compounds as well as any type thereof. Generally, however, the method will be used to treat hydrocarbons containing less than 5 grams of dissolved lead per gallon and the same will be most effective for treating liquid hydrocarbons having less than 0.5 grams of dissolved lead per gallon either as tetramethyl lead or as an equilibrated mixture of tetraethyl and tetramethyl lead. In this regard, it should be noted that the effective life of the cupric chloride impregnated adsorbent will depend, inter alia, upon the amount of lead actually separated therewith.

In a further embodiment of the present invention, the aforedescribed impregnated adsorbent may comprise an amine and as indicated supra, the amine may be present either as a reaction product or complex. In this regard, and while the inventors do not wish to be bound by any particular theory, it is believed that the amine forms a complex with the cupric chloride, and that this complex will be formed independently of the manner in which the amine is added. It is, however, possible that no reaction occurs or that other reactions could occur. For this reason, then, this embodiment of the invention will be described simply by reference to the addition and/or inclusion of an amine or amines in the contact material: it being understood that such description is intended to cover all possible forms and to include the addition of an amine (or amines) either as a complex or as another reaction product as well as the presence of the amine (or amines) in the contact material in one or more of the forms.

In any case, the contact material could be prepared by first impregnating the adsorbent with an amine or a mixture thereof and then adding the cupric chloride in the manner heretofore described; or by first impregnating the adsorbent with cupric chloride in the manner already described and then impregnating with the amine (or amines); or the amine could be incorporated directly into the cupric chloride impregnating solution and then effecting the impregnation simultaneously.

It will, of course, be appreciated that the particular method used to prepare the amin-containing contact material will depend, inter alia, on the particular amine or amines used and the solubility thereof and/or the solubility of any reaction product or complex that may be formed therewith. In this regard, it should be noted that it is important that the amine and/or any complex thereof be impregnated into the pores of the adsorbent and that the same be incorporated therein in an effective concentration. For these reasons, then, and when an amine having limited solubility in the cupric chloride solvent is used, the same will, generally, be impregnated into adsorbent with a different solvent and the impregnation will be accomplished either before or after the cupric chloride impregnation. Similarly, when an amine which forms an insoluble reaction product or complex (e.g., with the cupric chloride) is used, the amine and cupric chloride immpregnations will be accomplished separately rather than simultaneously.

In general, any amine, which is suffficiently soluble to ficilitate impregnation or any combination thereof could be used in this embodiment of the invention. Such amines include the primary, secondary, and tertiary mono-, di- and triamines containing hydrocarbon radicals, and particularly alkyl and alkylene groups, having from 2 to 16 carbon atoms. The lower molecular weight amines, which lend themselves to both separate and simultaneous impregnation are, however, most effective and best results have been achieved with the primary, mono-amines containing an alykyl group having from 2 to 8 carbon atoms. These primary amines are, therefore, most preferred. Operable amines include, but are not limited to, n-butylamine, triethylamine, ethylene diamine and diethylenetriamine.

In general, the amine, when used, will be used at a concentration within the range from about 0.1–1.0 mols of amine per mol of cupric chloride. When simply combined with the adsorbent either before or after the cupric chloride impregnation, a sufficient amount of amine to provide this relative concentration will be impregnated on the adsorbent separately. When the amine-cupric chloride impregnation is accomplished simultaneously, on the other hand, an amount of amine sufficient to provide the desired relative molar proportions will be added directly to the cupric chloride impregnating solution and the simultaneous impregnation accomplished in a manner analogous to that described with respect to the separate cupric chloride impregnation. In this embodiment too, the presence of water in the contact material is essential to effective lead separation. Generally, however, less water is required for optimum separation when an amine, in some form, is present and effective separation is achieved over a broader range of water contents in the contact material. Broadly, then, in this embodiment, the contact material will comprise between about 5 and 20 wt. % cupric chloride, between about 2 and 15 wt. % water, between about 0.1 and 5 wt. % amine and between about 60 and 92.9 wt. % adsorbent.

In general separation of the organolead compounds will be accomplished at a satisfactory rate with the contact materials of this invention when sufficient contact material is used to provide between about 1 and 20 grams of cupric chloride per gram of dissolved lead in the liquid hydrocarbon subjected to treatment. Moreover, the rate of reaction and/or adsorption will remain satisfactory, at least in those cases where the hydrocarbon does not contain other components which might interfere with the lead separation, until the amount of lead adsorbed is somewhere within the range of about 0.05 to about 1.0 grams of lead per gram of cupric chloride contained in the contact material. As will be readily apparent, then, in a batch operation separation can be effected by adding a fixed amount of the contact material to a fixed volume of liquid hydrocarbon, the amount added being determined by the amount of lead to be separated from the liquid hydrocarbon and the amount, if any, of other components which might also be reacted and/or adsorbed or which would otherwise decrease the adsorbent capacity. In a semi-batch or continuous operation, on the other hand, contacting with a fixed amount of contact material would be continued until the amount of lead reacted and/or adsorbed is sufficient to markedly or substantially reduce the rate of adsorption or until the concentration of lead in the treated hydrocarbon exceeds the desired concentrations.

It will, of course, be appreciated that good contacting between the dissolved lead and the contact material is important to a complete or effective separation. Such contacting could, of course, be achieved by shaking, agitation or the like or the same might be achieved by passing the liquid hydrocarbon through a fixed bed of the contacting material. In this regard, it should be noted that sufficient contacting will be accomplished when the liquid hydrocarbon is passed through a fixed bed of contact material having a particle size within the range heretofore specified at a rate within the range of about 2 to about 15 gallons per hour per lb. of contact material.

In general, the contacting between the lead containing liquid hydrocarbon and the contact material will be accomplished at a temperature between about 40° and 120° F. and a contacting time within the range of about 0.5 and about 5 minutes will be sufficient to effect the desired separation. The fact that the method of this invention can be operated at relatively low temperatures does, of course, offer a tremendous advantage since it is contemplated that the same might be used at retail outlets which would not offer convenient heating facilities. The process cannot, however, be operated at extremely low temperatures since the rate of reaction and rate of diffusion into the pores of the impregnated adsorbent would become too slow.

As indicated, supra, the method of this invention can be effectively used to separate relatively large lead concentrations from liquid hydrocarbons. Large lead concentrations will, however, significantly reduce the useful life of the contact material. This in turn would result in frequent replacement or regeneration of the contact material and present an economic disadvantage. For this reason, then, it may be desirable to combine the method of the present invention with a different or more conventional method of separating lead so that the life of the contact material can be prolonged. When this is done, a different and/or more conventional method of separating lead from liquid hydrocarbons will be used to reduce the tetraalkyl lead content to a concentration preferably below about 0.5 grams pergallon and most preferably below about 0.3 grams per gallon. The liquid hydrocarbon having a reduced tetraalkyl lead concentration would then be subjected to treatment with a cupric chloride impregnated adsorbent in the manner heretofore described.

As indicated supra, the method of the present invention can be used to separate dissolved organolead compounds from any liquid hydrocarbon. The process is particularly ueful, however, for the separation of organolead compounds such as tetraethyl lead and tetramethyl lead from mixtures of liquid hydrocarbons such as heating oil, diesel fuel, gasoline, jet fuel and kerosene and the same is most effective for separating tetramethyl lead or lead compounds containing both methyl and ethyl groups, especially in terms of improved capacity relative to copper chloride on carbon when silica gel is the adsorbent. The method of this invention is particularly useful for the separation of minor concentrations of such lead compounds from liquid hydrocarbon mixtures to be offered and sold as unleaded gasolines.

It will, of course, be appreciated that the performance of the several contact materials contemplated for use in the present invention will vary with several factors and particularly with the specific adsorbent used; the concentration of water contained therein; whether an amine is used, and when used, the specific amine that is used; the particular organolead compound or compounds that are to be separated; and the composition of the hydrocarbon being treated. It is possible to tailor a specific contact material for the treatment of a particular hydrocarbon and for the separation of any particular organolead compound. In this regard, it should be noted that those contact materials prepared with an alumina adsorbent will generally, exhibit faster reaction and/or adsorption rate, when used to adsorb tetraethyl lead or an equilibrated mixture of tetraethyl and tetramethyl leads than those contact materials prepared with either silica-alumina or a silica gel. The reaction and/or absorption capacity of the alumina based contact materials for equilibrated mixtures, on the other hand, generally will be lower than the corresponding reaction and/or adsorption capacities of the silica gel and silica-alumina based adsorbent. Conversely, the contact materials prepared with a silica gel will, generally, exhibit a greater reaction and/or adsorption capacity, when used to separate tetramethyl lead or equilibrated mixtures of tetramethyl and tetraethyl leads, but the initial reaction and/or adsorption rate will be, generally, slower than that realized with the alumina and silica-alumina based contact materials, for the equilibrated mixtures of tetramethyl and tetraethyl leads.

It should also be noted that the incorporation of an amine into the various contact materials useful in the method of this invention will alter the relative adsorption capacity and the adsorption rate thereof. The favorable effect of such use is, however, most pronounced when contact material comprising silica gel is used. Such use is, therefore, most preferred.

PREFERRED EMBODIMENT

In a preferred embodiment of the present invention a contact material comprising a silica gel impregnated with an aqueous methanolic solution of cupric chloride and containing between about 8 and 15 wt. % $CuCl_2$, 7 to 12 wt. % water, and between about 73 and 85 wt. % silica gel (on a water-free basis), will be used to separate equilibrated mixtures of tetramethyl lead and tetraethyl lead from gasolines intended to be sold and used as unleaded gasolines within the meaning of recent Federal legislation, i.e., gasolines containing no more than 0.05 g Pb/gallon. The silica gel thus used will have a surface area within the range from about 300 to about 600 $m^2/g$ and a pore volume within the range from about 0.9 to 1.3 cc/g. The separation will be accomplished by contacting the lead containing gasoline with the cupric chloride impregnated adsorbent at a temperature between 60° and 85° F. such that the actual contacting time between the leaded fuel and the adsorbent will be between about 1 and 3 minutes.

In the preferred embodiment, the lead concentration in the gasoline will be less than 0.5 g/gallon and most preferably the lead concentration will be less than 0.3 g/gallon. Also, the contacting with the contact material will be accomplished in a fixed bed containing particles having an average particle size within the range of about 0.01 to about 0.05 inches and the contacting will be accomplished at a flow rate between about 4 and about 10 gal. (gasoline) per hour per pound of contact material.

In a most preferred embodiment of the present invention, a contact material comprising from about 8 to about 13 wt. % cupric chloride, from about 3 to 10 wt. % water, from about 0.5 to 3.5 wt. % n-butyl amine and from about 73.5 to 88.5 wt. % silica gel (on a water-free basis) will be used to separate an equilibrated mixture of tetramethyl and tetraethyl lead from gasoline. This contact material will be used in the same manner as the preferred contact material and the same will be prepared by first complexing the butyl amine with the copper chloride used to prepare the contacting material by combining therewith between about 0.1 and 0.5 mols of amine per mol of copper chloride.

It is believed that the present invention will become even more apparent from the following examples which illustrate the broadest embodiment thereof, a preferred embodiment thereof and a most preferred embodiment thereof. These examples also compare the results obtained by the method of this invention with both prior art methods and methods closely analogous to that of present invention. These examples are not, however, intended to limit the invention in any way.

EXAMPLE 1

A contact material was prepared by impregnating a silica gel with hydrous cupric chloride. The preparation was accomplished by first dissolving 7.2 grams of $C_uCl_2 \cdot 2H_2O$ in mixed solvent containing 9.0 grams of water and 45.0 grams of methanol and then combining this solution with 40.0 grams of granular silica gel containing 5.2 wt. % water. The particle size of the granular silica gel was such that the same all passed through a 40 mesh (U.S.) screen and was retained on a 60 mesh (U.S.) screen. The silica gel had a total pore volume of 1.1 ml/g. and a surface area of about 340 $m^2/g$. The cupric chloride solution and the silica gel were combined at about room temperature and the combined mixture was stirred until the silica gel was thoroughly wetted. The combined mixture was then dried by tumbling in air at an air temperature of about 50° C. for a period of 1.5 hours. The resulting adsorbent contained 11.8 wt.% $CuCl_2$, 10.0 wt. % $H_2O$ and 78.2 wt. % silica gel (on a water-free basis). Ten grams of the impregnated silica gel thus prepared were placed in a fixed bed and contacted with 4 liters of gasoline containing 0.14 grams Pb/gallon (as an equilibrated, equimolar mixture of tetraethyl and tetramethyl lead) at about 75° F., such that the average contact time was about 1 minute.

During the contacting, the flow of gasoline was sufficient as to assure the desired degree of contacting between the lead and the adsorbent. After completion of the contacting, the treated gasoline was filtered to separate any suspended solids remaining therein. The treated gasoline was then analyzed and found to contain 0.02 grams Pb/ gallon.

As will be readily apparent, then, approximately 85% of the dissolved lead was removed and the resulting product contained less than 0.05 grams Pb/gallon. The resulting product could, then, be sold as an unleaded gasoline within the meaning of recent Federal legislation.

EXAMPLE 2

The procedure of Example 1 was repeated except that a gasoline comprising 0.13 g Pb (as tetraethyl lead)/gal. was substituted for the gasoline containing the equilibrated, equimolar mixture of tetramethyl and tetraethyl lead. After the treatment, the lead content of the gasoline was 0.11 g/gallon.

EXAMPLE 3

The procedure of Example 1 was again repeated except that in this run, a gasoline containing 0.12 g Pb (as tetramethyl lead)/gallon was substituted for the gasoline containing the equilibrated lead mixture. After the treatment, the lead content of the gasoline was 0.03 g/gal.

EXAMPLE 4

In this Example, a series of contact materials were prepared by impregnating with a solution of cupric chloride in substantially the same manner as that set forth in Example 1 except that the relative concentrations and the drying time were modified to produce a product containing a relatively constant cupric chloride content but a varying water content. The contact materials actually produced contained between about 10 and 12 wt. cupric chloride and the water content varied from 1 to 15 wt. %.

Each contact material of this series was then used to treat an average of about 4 liters of a gasoline containing 0.14 g. Pb (as an equilibrated, equimolar mixture of tetraethyl and tetramethyl lead)/gallon at an average contact time of 1 minute and in substantially the same manner as described in Example 1. The lead content of the treated gasoline obtained with each contact material was then determined and this lead content is plotted in FIG. 1 as a function of the water content of the contact material. As can be seen from the Figure, effective separation was realized over most of the range of water concentration tested and particularly at water concentrations between about 3 and about 15 wt. %. More effective results were, however, realized at water contents ranging from about 7 to about 12 wt. %.

EXAMPLE 5

A contact material was prepared by impregnating a porous silica-alumina having a particle size of 20 × 100 mesh and comprising 86 wt. % silica and 13 wt. % alumina with cupric chloride. The preparation was accomplished by first dissolving 5 g. cupric chloride dihydrate in a mixed solvent comprising 6 g. water and 30.0 g. methanol and thereafter combining this solution with 30 g. of the silica-alumina. The silica-alumina used in this Example had a total pore volume of 0.9 ml/g, and a surface area of about 400 $m^2/g$. The preparation was identical to that set forth in Example 1, except that the silica-alumina was substituted for the silica gel. The impregnated product thus obtained contained 11.5 wt. % $CuCl_2$, 10.7 wt % water, and 77.8 wt. % silica-alumina. 10 grams of this impregnated adsorbent were then used to treat 4 liters of gasoline containing 0.14 g. Pb (as an equilibrated, equimolar mixture of tetraethyl and tetramethyl lead)/gallon in the same manner and at the same conditions as used in Example 1. Following the contacting, the gasoline was analyzed for lead content and the lead content found to be 0.03 g. Pb/gallon.

EXAMPLE 6

The procedure of Example 5 was repeated except that a gasoline comprising 0.13 g Pb (as tetraethyl lead)/gallon was substituted for the gasoline containing the equilibrated, equimolar mixture of tetramethyl and tetraethyl lead. After the treatment, the lead content of the gasoline was 0.065 g/gallon.

EXAMPLE 7

The procedure of Example 5 was again repeated except that in this run, a gasoline containing 0.13 g Pb (as tetramethyl lead)/gallon was substituted for the gasoline containing the equilibrated lead mixture. After the treatment, the lead content of the gasoline was 0.02 g/gal.

EXAMPLE 8

A contact material was prpepared by impregnating a silica gel identical with that used in Example 1 (except that the particle size was 20 × 60 mesh) with a solution containing the reaction product of n-butylamine and copper chloride. The preparation was accomplished by first dissolving 6.6 g. $CuCl_2 \cdot 2H_2O$ and 0.70 g. n-butylamine in a mixed solvent comprising this solution with 40.5 g. silica gel identical to that used in Example 1. The preparation was accomplished in a manner substantially identical to that set forth in Example 1 except that nitrogen was used for drying and the conditions were varied so as to produce a contact material containing 10.9 wt. % $CuCl_2$, 1.4 wt. % n-butylamine (believed to be complexed with at least a portion of the $CuCl_2$), 7.3 wt. % water and 80.4 wt. % silica gel. Ten grams of this material were then used to treat 4 liters of a gasoline containing 0.14 g. Pb (as an equilibrated, equimolar mixture of tetraethyl and tetramethyl lead)/gallon in the same manner and at the same conditions as described in Example 1. Following the contacting, the treated gasoline was analyzed for lead content and the same was 0.01 g. Pb/gallon.

EXAMPLE 9

A contact material was prepared by impregnating a porous alumina with cupric chloride. The preparation was accomplished by first dissolving 3.4 g. cupric chloride dihydrate in a mixed solvent comprising 3.6 g. of water and 18 g. methanol and thereafter combining this solution with 20 g. of alumina havig a particle size of 20 × 100 mesh. The alumina used in this Example had a total pore volume of about 0.8 ml/g., and a surface area of about 200 $m^2/g$. The preparation was identical to that set forth in Example 1, except that the alumina was substituted for the silica gel. The impregnated product thus obtained contained 11.5 wt. % $CuCl_2$, 6.4 wt. % water, and 82.1 wt. % alumina. 10 grams of this impregnated adsorbent were then used to treat 4 liters of gasoline containing 0.14 Pb (as an equilibrated, equimolar mixture of tetraethyl and tetramethyl lead)/gallon in the same manner and at the same conditions as used in Example 1. Following the contacting, the gasoline was analyzed for lead content and the lead content found to be 0.03 g. Pb/gallon.

EXAMPLE 10

The procedure of Example 9 was repeated except that a gasoline comprising 0.13 g Pb (as tetraethyl lead)/gallon was substituted for the gasoline containing the equilibrated, equimolar mixture of tetramethyl and tetraethyl lead. After the treatment, the lead content of the gasoline was 0.03 g/gallon.

EXAMPLE 11

The procedure of Example 9 was again repeated except that in this run, a gasoline containing 0.13 g Pb(as tetramethyl lead)/gallon was substituted for the gasoline containing the equilibrated lead mixture. After the treatment, the lead content of the gasoline was 0.10 g/gallon.

EXAMPLE 12

Figure 2:
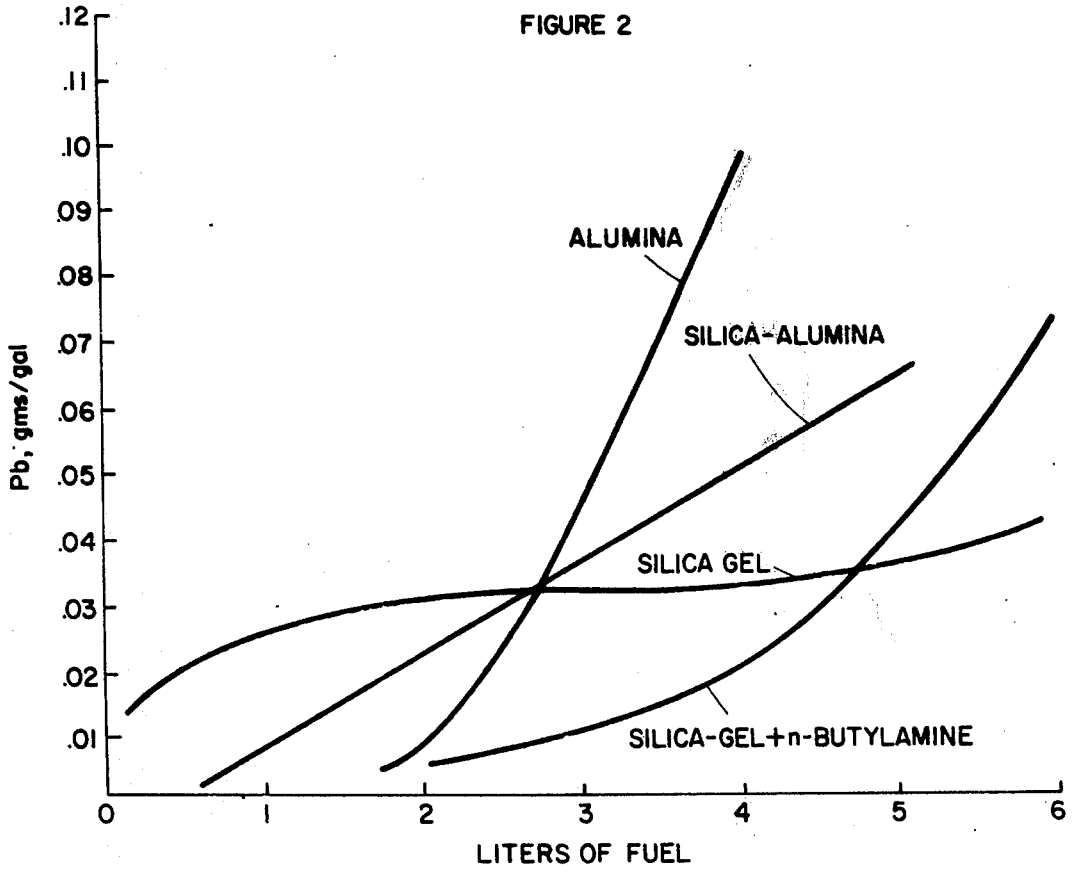
FIG. 2 is a plot illustrating the effectiveness of several contact materials, within the scope of the present invention with continued use and based on the data obtained in Example 12.

In this Example, a series of four contacting materials identical to those prepared and used in Examples 1, 5, 8 and 9 were prepared in a manner substantially identical to that summarized in the respective Examples. Each of the contact materials were then used to separate lead from a gasoline containing 0.14 g Pb/gallon (as an equilibrated equimolar mixture of tetramethyl and tetraethyl lead). The contacting was accomplished at 75° F. with 10 grams of impregnated adsorbent at a contact time of 1 minute. Each run was continued until 6 liters of gasoline had passed through the bed or until the activity had significantly decreased. The lead content of the effluent from the bed was periodically determined and the value thus determined has been plotted for each of the contact materials at various treated volumes in FIG. 2.

As can be seen from the Figure, then, the alumina based contact material provided the most effective separation at the lower treated volumes but its effectiveness decreased rapidly at the higher treated volumes. The silica-alumina based contact material, on the other hand, while not yielding the same degree of separation, initially, did not drop nearly as rapidly at the higher treated volumes. As will also be apparent from the Figure, the silica gel base contact material provided the best overall separation (of the non-amine treated materials) although the degree of separation, initially, was not as good as that obtained from the alumina and the silica-alumina based contacting materials. Finally, and as will also be apparent from the Figure, the n-butylamine treated contact material exhibited excellent separation and good capacity for an extended period, although its activity during the final liter of treat was less than that of the silica gel based adsorbent.

EXAMPLE 13

The procedure of Example 8 was repeated except that a gasoline containing 0.14 g Pb (as tetraethyl lead)/gallon was substituted for the gasoline containing an equilibrated, equimolar mixture of tetraethyl and tetramethyl lead. After the treatment, the treated gasoline used in this Example contained 0.06 g Pb/gallon.

EXAMPLE 14

The procedure of Example 1 was repeated except that isooctane containing 0.45 g Pb (as tetraethyl lead)/gallon was substituted for the gasoline used in that Example. After the treatment, the lead content of the isooctane was 0.01 g Pb/gallon.

EXAMPLE 15

A contact material was prepared by impregnating a silica gel identical with that used in Example 8 with a solution containing the reaction product of n-butylamine and copper chloride. The preparation was accomplished by first dissolving 6.6 g. $CuCl_2 \cdot 2H_2O$, and 0.35 g. n-butylamine in a mixed solvent comprising 7.0 g. of $H_2O$, 35.5 g. methanol and thereafter combining this solution with 40.0 g. silica gel identical to that used in Example 1. The preparation was accomplished in a manner substantially identical to that set forth in Example 8 except that the conditions were varied so as to produce a contact material containing 11.0 wt. % $CuCl_2$, 0.7 wt. % n-butylamine (believed to be complexed with at least a portion of the $CuCl_2$), 8.4 wt. % water and 79.9 wt. % silica gel. 10 grams of this material were then used to treat 6 liters of a gasoline containing 0.14 g. Pb (as an equilibrated, equimolar mixture of tetraethyl and tetramethyl lead)/gallon in the same manner and at the same conditions as described in Example 1. Following the contacting, the treated gasoline was analyzed for lead content and the lead content was 0.02 g. Pb/gallon.

While the present invention has been described and illustrated by reference to particularly preferred embodiments thereof, it will be appreciated that the same lends itself to several variations which would be obvious to those of ordinary skill in the art. Reference should, therefore, be made solely to the appended claims to determine the scope of the present invention.

What is claimed is:

1. A method for separating an organolead compound from liquid hydrocarbons comprising the steps of: contacting a liquid hydrocarbon containing an organolead compound dissolved therein with a contact material, said contact material comprising between about 5 and about 20 wt. % $CuCl_2$, between about 3 and 155 wt. % water and between about 65 and about 92 wt. % adsorbent, said adsorbent being selected from the group consisting of silica gel, alumina and silica-alumina, and said $CuCl_2$ being impregnated on said adsorbent and recovering a liquid hydrocarbon having a reduced dissolved lead content therein.

2. The method of claim 1 wherein the adsorbent is a silica gel having a total pore volume within the range of about 0.7 to about 1.5 ml/g; and a surface area within the range of about 100 to about 800 $m^2/g$.

3. The method of claim 1 wherein the contact material comprises between about 8 and 15 wt. % $CuCl_2$, between about 7 and 12 wt. % water and between about 73 and 85 wt. % adsorbent.

4. The method of claim 3 wherein the adsorbent is silica gel having a total pore volume within the range from about 0.9 to about 1.3 cc/g and a surface area within the range from about 300 to about 600 $m^2/g$.

5. The method of claim 1 wherein the contacting is accomplished at a temperature between about 40° and about 120° F.

6. The method of claim 5 wherein the contacting is accomplished in a fixed bed and continued for a period of time between about 0.5 and about 5 minutes.

7. The method of claim 6 wherein the liquid hydrocarbon contains less than about 0.5 g. Pb/gallon.

8. The method of claim 7 wherein said organolead compound is a tetraalkyl lead compound.

9. A method for separating an organolead compound from liquid hydrocarbons comprising the steps of: contacting a liquid hydrocarbon containing an organolead compound dissolved therein with a contact material, said contact material comprising between about 5 and 20 wt. % $CuCl_2$, between about 0.1 and 5.0 wt. % amine, between about 2 15 wt. % $H_2O$ and between about 60 and 92.9 wt. % absorbent, said adsorbent being selected from the group consisting of silica gel, alumina and silica-alumina, and said $CuCl_2$ being impregnated on said adsorbent, and recovering a liquid hydrocarbon having a reduced dissolved lead content therein.

10. The method of claim 9 wherein said contact material comprises between about 8 and 13 wt. % cupric chloride, between about 0.5 and 3.5 wt. % amine, between about 3 and 10 wt. % $H_2O$ and between about 73.5 and 88.5 wt. % adsorbent.

11. The method of claim 9 wherein the molar ratio of amine to cupric chloride is within the range from 0.1:1 and 1:1.

12. The method of claim 10 wherein the molar ratio of amine to cupric chloride is within the range from 0.1:1 to 0.5:1.

13. The method of claim 12 wherein the amine is a primary mono amine having 2 to 8 carbon atoms therein.

14. The method of claim 9 wherein the adsorbent is silica gel.

* * * * *

UNITED STATES PATENT OFFICE

CERTIFICATE OF CORRECTION

Patent No. 3,998,725 Dated December 21, 1976

Inventor(s) Abraham A. Zimmerman and George S. Musser

It is certified that error appears in the above-identified patent and that said Letters Patent are hereby corrected as shown below:

Column 11, line 42, after comprising the recitation --7g. $H_2O$, 35 g. methanol and thereafter combining-- should appear; Column 13, line 49, the recitation "3 and 155" should read --3 and 15--; and Column 14, line 31, the recitation "about 215 wt. %" should read -- about 2 and 15 wt. %--.

Signed and Sealed this

Twenty-sixth Day of April 1977

[SEAL]

*Attest:*

RUTH C. MASON
*Attesting Officer*

C. MARSHALL DANN
*Commissioner of Patents and Trademarks*